US005897946A

United States Patent [19]

Nachtman et al.

[11] Patent Number: 5,897,946

[45] **Date of Patent: *Apr. 27, 1999**

[54] FLOWABLE MATERIAL TO ISOLATE OR TREAT A SURFACE

[75] Inventors: Thomas J. Nachtman, Temperance, Mich.; John H. Hull, Toledo, Ohio

[73] Assignee: New Waste Concepts, Inc., Erie, Mich.

[ * ] Notice: This patent is subject to a terminal disclaimer.

[21] Appl. No.: 08/682,306

[22] Filed: Jul. 17, 1996

Related U.S. Application Data

[63] Continuation-in-part of application No. 08/268,633, Jun. 30, 1994, Pat. No. 5,538,787, which is a continuation-in-part of application No. 08/243,687, May 16, 1994, abandoned

[60] Provisional application No. 60/008,870, Dec. 19, 1995.

[51] Int. Cl.[6] ..... B32B 5/16; E02B 3/12; B01D 39/00

[52] U.S. Cl. ..... 428/323; 405/17; 405/268; 405/270; 428/403; 428/404; 428/407; 428/688

[58] Field of Search ..... 428/323, 403, 428/407, 688, 404; 405/17, 268, 270; 210/503, 504, 502.1, 506, 696, 807

[56] References Cited

U.S. PATENT DOCUMENTS

| | | | |
|---|---|---|---|
| 2,277,286 | 3/1942 | Bechtner | 61/30 |
| 2,728,733 | 12/1955 | Hashimoto | 252/449 |
| 4,011,175 | 3/1977 | Preus | 252/427 |
| 4,790,940 | 12/1988 | Castaldi et al. | 210/611 |
| 5,035,804 | 7/1991 | Stowe | 210/671 |

FOREIGN PATENT DOCUMENTS

| | | | |
|---|---|---|---|
| A-0567692 | 11/1993 | European Pat. Off. | E02D 31/00 |
| A-3908628 | 9/1990 | Germany | E02D 31/00 |
| WO 95/31609 | 11/1995 | WIPO | E02B 3/16 |

OTHER PUBLICATIONS

USDA Den. Wild. Res. Ctr. Tech. Rep., pp.429–444 (Jan. 1995).

*Primary Examiner*—Hoa T. Le
*Attorney, Agent, or Firm*—MacMillan, Sobanski & Todd, LLC

[57] ABSTRACT

A flowable material to isolate or treat a surface consists of a plurality of manufactured composite particles. Each composite particle includes a core, and a sealant layer at least partially encapsulating the core. The core is relatively dense compared to the sealant layer, and the composite particle has a specific gravity greater than one. The sealant layer includes a clay mineral, a pozzolanic material and/or activated carbon. A sealant layer formed of a pozzolanic material creates a hardened underwater barrier layer. The sealant layer can also include natural fibers such as cellulose or man-made fibers such as glass, carbon or plastics to mechanically improve the geotechnical properties of the layer when hydrated. The composite particles can also include a material to treat the contaminants or otherwise improve the surrounding environment.

26 Claims, 1 Drawing Sheet

FLOWABLE MATERIAL TO ISOLATE OR TREAT A SURFACE

CROSS REFERENCE TO RELATED APPLICATIONS

This application is a continuation-in-part of both copending U.S. provisional application Ser. No. 60/008,870, filed Dec. 19, 1995, and copending U.S. application Ser. No. 08/268,633, filed Jun. 30, 1994, now U.S. Pat. No. 5,538,787, which is a continuation-in-part of U.S. application Ser. No. 08/243,687, filed May 16, 1994, now abandoned.

BACKGROUND OF THE INVENTION

The invention relates generally to materials for isolating or treating a surface, and more particularly to a flowable material for forming a barrier layer having low permeability over a contaminated underwater surface or a land surface.

A significant number of lakes, ponds, marshes, river beds and ocean areas near coastlines are contaminated with environmentally hazardous materials. Examples of such materials include polychlorinated biphenyls ("PCB's"), white phosphorus, synthetic organic compounds, and various metals. Many of these materials, once introduced by one means or another, settle on the bottoms of such bodies of water or become attached to sediments. The resulting contaminated sediments are detrimental to the ecosystem, especially wildlife which utilizes the body of water, such as fish, foraging waterfowl and small vertebrates. In some cases the contaminants are slowly released from the sediments and re-introduced into the water column.

In some cases, it is not feasible to remove or treat such sediment in situ. Thus, to prevent the wildlife from coming into contact with the contaminated sediment and to seal the sediment from coming into contact with the water column, it has been proposed to form an underwater barrier layer over the contaminated sediment. Previous methods have been relatively difficult and expensive to install, and have been susceptible to damage. Thus, it would be desirable to provide a durable, relatively simple and inexpensive material for forming a barrier layer over a contaminated underwater surface. At times it would also be desirable to provide a method of forming a barrier layer over a contaminated underwater surface which could be repeated occasionally to allow for replenishment of the barrier layer. Other times it would be advantageous to form a more permanent underwater barrier layer which forms a hard shell over the contaminated surface. It would frequently be desirable to apply a material to the underwater surface to treat a particular type of contamination, or to restore or improve the surface.

Landfill sites are typically constructed by completing an excavation in the ground and lining the excavation to form a containing system prior to filling with waste materials. Unfortunately, the landfill is susceptible to leaching contaminants into the surrounding ground and possibly into the water table. The upper surface of the landfill attracts pests such as birds and rodents which can possibly carry diseases. Accordingly, it would be desirable to provide a low permeability barrier layer useful as a liner for a landfill to prevent the leaching of contaminants into the ground, and useful as a low permeability cap to keep pests away from the waste material and to minimize infiltration of water. If the landfill were covered by such a cap or included such a liner system, it would be important for quality control purposes to provide a relatively uniform distribution of materials in the cap or liner system.

In addition to landfill sites, other land surfaces such as newly excavated ponds or reservoirs could also benefit from such a barrier layer to hold the water in and prevent leakage into the surrounding area. A barrier layer could also be used to cover hazardous waste sites. Thus, there is a need for a material capable of forming a low permeability barrier layer on land surfaces. It would particularly be advantageous if the barrier layer could withstand repeated freeze/thaw and dehydration/rehydration cycles resulting from meteorological or climatological variances. In remediation projects it could be advantageous to use free-flowing aggregate-like materials to fill excavations where stability and a water retarding barrier are desirable.

SUMMARY OF THE INVENTION

The invention relates to a flowable material for isolating or treating a surface. The invention is particularly suitable for forming a barrier layer over a contaminated underwater surface, or on a land surface such as a landfill site or a belowground excavation such as a trench. The barrier layer has a low permeability to minimize the leakage of water and contaminants. It also provides a barrier to pests such as birds and rodents. The flowable material comprises a plurality of manufactured composite particles. Each of the composite particles includes a core, preferably formed of a piece of gravel or other inert material such as glass cullet or crushed glass. A sealant layer is provided which at least partially encapsulates the core. The sealant layer includes a clay mineral, a pozzolanic material and/or activated carbon. A sealant layer formed of a pozzolanic material creates a hardened underwater barrier layer. The sealant layer can also include natural fibers such as cellulose or man-made fibers such as glass, carbon or plastics to mechanically improve the geotechnical properties of the layer when hydrated. The composite particles can also include a material to treat the contaminants or otherwise improve the surrounding environment. To form an effective underwater barrier layer over contaminated sediments beneath a body of water, a plurality of the composite particles are deposited on top of the contaminated sediments. The resulting barrier layer blocks contamination, yet allows vegetation to naturally reestablish itself. The material is also stable through harsh weather cycles, including the freezing, thawing, and flooding encountered in many climates.

Various objects and advantages of the invention will become readily apparent to those skilled in the art from the following detailed description of a preferred embodiment when considered in the light of the accompanying drawings.

DETAILED DESCRIPTION OF THE PREFERRED EMBODIMENT

Figure 1:
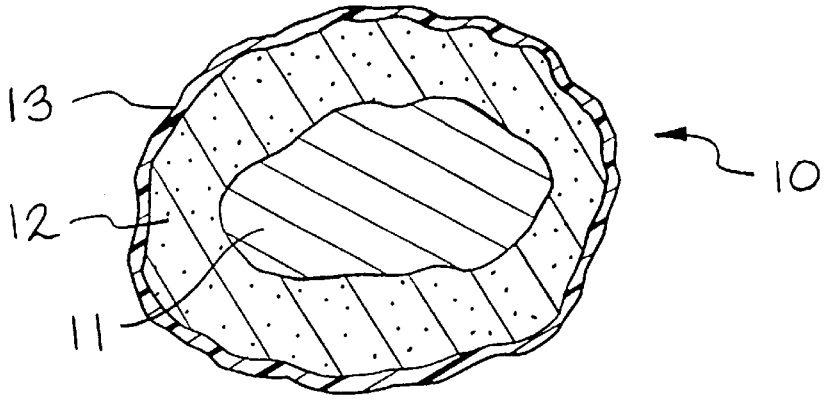
FIG. 1 is a sectional view of a single composite particle for forming a barrier layer in accordance with this invention.

Referring now to the drawings, FIG. 1 illustrates a composite particle, indicated generally at 10, for forming a barrier layer in accordance with this invention. As will be discussed in detail below, a plurality of such composite particles 10 are typically required to form an effective barrier layer. The composite particles easily flow from a bucket, chute, pipeline or other distribution apparatus, and they quickly sink in water to form a barrier layer over an underwater surface.

The composite particles can also be distributed to form an effective barrier layer on a land surface such as at a sanitary landfill, hazardous waste site, or newly excavated pond or reservoir. For example, when used as a cap at a landfill site, the composite particles can be dumped on the landfill surface and then leveled out to form a barrier layer. Advantageously, the materials comprising the composite particles are relatively uniformly distributed in the barrier layer. This is an important quality control issue for barrier layers at landfill sites. The barrier layer also keeps pests such as birds and rodents away from the covered waste material.

A barrier layer in accordance with this invention has a low permeability so that it is resistant to leakage of water and contaminants. When hydrated, the barrier layer preferably has a permeability of less than $1\times10_{-7}$ cm/sec. under a minimum hydraulic gradient of 1 cm/cm according to ASTM Method D 5084-90.

The size of the composite particle 10 can range from a small pebble to a large size rock or even larger. Preferably the composite particle is generally spherical in form, but it can also be other shapes such as oval, oblong or irregular. The composite particle is formed of a core 11 which is at least partially encapsulated by a sealant layer 12. The core is preferably completely encapsulated by the sealant layer. In a preferred embodiment, a protective coating 13 is provided over the sealant layer 12. Each composite particle has a specific gravity which is greater than one.

The core 11 of the composite particle 10 is formed of a piece of a material which is relatively dense and preferably relatively hard when compared to the sealant layer 12. The core must be relatively dense because it acts as a carrier of the composite particle to the isolated or treated surface. Examples of suitable materials for forming the core include pieces of rock or stone, iron ore, slag, glass cullet, crushed glass or crushed porcelain. Preferably, the core of the composite particle is formed of a piece of gravel.

In another embodiment, where the invention is used as an underwater barrier layer, the core of the composite particle is formed of a degradable material so that it can slowly dissipate over a period of time. The use of a degradable core offers some advantages. It facilitates hydraulic dredging operations. A degradable core also allows the underwater surface to be replenished with a new barrier layer from time to time, such as for revegetation of the surface. As will be discussed below, a degradable core can also deliver remediation/restoration materials to the underwater surface.

Various materials can be used to form a degradable core so long as the core remains relatively dense compared to the sealant layer and the composite particle as a whole has a specific gravity greater than one. Sand is a preferred material for forming a degradable core. The sand will function as a carrier of the composite particle to an underwater surface, and when hydrated it will disperse into the material of the sealant layer. Other suitable materials for the degradable core include very small stones or rocks, rubber tire chips, sugar-based materials such as rock candy, pelletized recycled paper such as magazines or newspapers, pelletized clay mineral that hydrates very slowly, or high-density fertilizer. These materials can be held together by a binder, such as those used in the sealant layer, to create any size core needed.

The core of the composite particle can also be formed of pozzolanic materials such as gypsum, gypsum fines, portland cement, cement kiln dust, lime dust, stone dust, fly ash, and plaster of Paris. These materials will be described in more detail below.

The core 11 of the composite particle 10 is at least partially encapsulated by a sealant layer 12. The material in the sealant layer acts as the main barrier for the contaminants on the isolated surface. A preferred type of material for the sealant layer is a clay mineral, or a mixture of clay minerals, which exhibits a high absorption and swelling capacity. Preferably a dry clay mineral is used in the sealant layer. This material is composed of negatively charged, extremely small clay mineral particles that have a very large ratio of surface area to mass. These properties make the dry clay mineral hydrate readily when exposed to water, expanding into a cohesive, plastic soil mass with very low permeability. The clay mineral can be a bentonite clay which is readily hydratable, such as calcium bentonite or sodium bentonite. In certain applications, especially in water having a relatively high salt content, the preferred clay mineral is attipulgite clay. The sealant layer may also include one or more organically modified clay minerals, which also are referrred to as "organo clays". Such organo clays are effective in binding with some contaminants, such as hydrocarbons or other organic materials, which come into contact with them.

A clay mineral forms a soft underwater barrier layer that slowly dissipates into the water over a prolonged period of time. On some underwater surfaces, it may be desirable to form a more permanent underwater barrier layer which forms a hardened, impermeable shell over the contaminated surface. The barrier layer would form a hard crust barrier that is more like concrete than a soft clay mineral. Such a barrier layer would be useful, for example, on underwater surfaces that require positive resistance to current flow or underwater turbulence.

A pozzolanic material can be used in the sealant layer to create such a hardened barrier layer. The term "pozzolanic material" means a material that is capable of setting and hardening under water. Suitable pozzolanic materials include gypsum, gypsum fines, portland cement, cement kiln dust, lime dust, stone dust, fly ash, and plaster of Paris. Gypsum, portland cement and its cement kiln dust byproduct are preferred. Fly ash is soot and ash produced by burning wood or coal or other biomass fuels. The setting nature of the pozzolanic material creates a more permanent barrier layer. These materials can be used in place of the clay mineral, or they can be used in mixtures with the clay mineral to create intermediate hardness barrier layers.

Activated carbon is another suitable material for inclusion in the sealant layer. The primary advantage of activated carbon is that it is capable of absorbing a large number of contaminants from the isolated or treated surface.

The sealant layer 12 can also include a binder. The binder promotes the adhesion of the sealant layer to the core 11. An amount of the binder sufficient to bind the sealant layer to the core is mixed with the sealant material. Alternatively, a layer of the binder may be interposed between the sealant material and the core. The binder also acts as a retardant to inhibit setting or expanding of the sealant material until it is positioned on the underwater surface. The binder is preferably a polymeric material, such as a cellulosic polymer. A preferred cellulosic polymer is guar gum. Other preferred cellulosic polymers include hydroxyethyl cellulose polymer and carboxymethyl cellulose polymer. Other suitable binders include glues such as 3M organic solvent glue, lignites (sap) from trees such as those marketed by Arizona Chemical, starch grafted polyacrylates such as Sanwet marketed by Hoechst Celanese, and soybean oil lecithins and their derivatives.

Water is another suitable binder, but it should be used in small amounts to avoid the composite particles becoming sticky, difficult to handle and unflowable. In one embodiment of the invention, the composite particles are manufactured by coating a core with water and then applying the sealant layer around the coated core. For example, a piece of gravel can be coated with water, and then coated with a sealant material such as activated carbon, bentonite clay, gypsum, or organo clay.

In a preferred embodiment of the invention, a remediation/restoration material is added to the composite particle. This material treats contamination or otherwise restores or improves the surrounding environment. An all purpose material can be designed for general use, or the material can be specifically targeted to treat a particular contamination. The need for specifically designed materials is readily apparent in view of the diversity of contaminants and combinations thereof present in the environment, particularly in underwater sediments or landfill sites.

Remediation/restoration materials can include, for example, bacteria designed specifically to treat contamination from solvents, oils or other hydrocarbons. For example, oil eating bacteria can be added to the binder or sealant layer of the composite particles to clean up contamination of sediments by heavy oil. An enzyme or a fungus may be a particularly desirable material to treat a particular contamination. A preferred composite particle includes clay or gypsum, fertilizer, and a microorganism selected from bacteria, algae and fungi. The fertilizer acts as a host material for the bacteria to feed on in addition to the contaminants.

Other such materials can include neutralizing agents such as peroxides or permanganates. Remedial chemicals can also be added, such as methoxypolyethylene glycol to treat PCB's. Activated carbon can also be added to remove contaminants.

Another suitable remediation/restoration material is an algae such as in the microbial mats inoculated with algae developed at Clark Atlanta University by Bender and Philips. In these microbial mats, fermented grass clippings are inoculated with blue-green algae. The algae can feed on contaminants on the treated surface as well as the grass, transforming organic contaminants into carbon dioxide.

Besides materials to treat a particular contamination, other materials can be added to the composite particles to restore or improve the surrounding environment, particularly an underwater surface. For example, seeds and/or fertilizer can be added to an underwater surface to promote the growth of grasses and other vegetation. A preferred combination of materials to build or rejuvenate a marsh includes seeds, fertilizer, enzymes and bacteria.

The remediation/restoration material is preferably added to the sealant layer of the composite particle. However, it can also be added to or comprise the core of the composite particle so long as the core retains its required density. For example, a remedial chemical or seeds can be added to a degradable core. As another example, the core can comprise a high-density fertilizer.

A bird aversion agent may also be added to the composite particles 10. Suitable bird aversion agents include esters of anthranilic acid, esters of phenylacetic acid, or dimethyl benzyl carbinyl acetate, as examples. Preferred bird aversion agents are dimethyl anthranilate and methyl anthranilate. The bird aversion agent is mixed with the sealant layer or degradable core in amounts sufficient to repel foraging waterfowl which would come into contact therewith.

An animal aversion agent such as capsium may also be added to the composite particles. When the composite particles are used to form a cap over a landfill site, the addition of the animal aversion agent will prevent animals from digging through the cap into the trash.

The composite particle 10 may be provided with an outer coating 13 which aids in keeping the sealant layer 12 intact prior to the deposition of the composite particle on an underwater surface. Preferably, the composite particle is provided with a thin polymeric coating about the sealant layer. Preferred materials for the outer coating are an acrylic resin or a latex. The outer coating should not be of a thickness, dependent upon the particular material, which would prevent the eventual hydration of the sealant layer of the composite particle after it is placed underwater.

The composite particles 10 in accordance with the invention may be formed in any suitable manner. In one embodiment, the binder is placed into an aqueous solution. Enzymes and/or bacteria are preferably mixed into the aqueous binder solution, so that they become intimately mixed with all the other ingredients. The sealant material is mixed into the aqueous solution. If the composite particles include remedial chemicals, they preferably are premixed with the sealant material such as bentonite. A number of the cores 11 are added to this sealant mixture and stirred so that the sealant mixture adheres to each of the cores. The sealant mixture may be allowed to dry about the cores, and then stirred with additional sealant mixture to form a multi-layered sealant layer 12 about each of the cores. The outer coating 13 may then be applied by any suitable means, such as by spraying.

Preferably the composite particles 10 are formed by compressing and compacting the sealant layer against the core. For example, the sealant material and optional binder can be placed into a roller such as a concrete mixer. The cores such as pieces of gravel are also placed into the roller. Rotation of the roller causes the cores to become coated with sealant material and to fall and collide against the wall of the roller. This packs the sealant material tightly around the core.

Figure 2:
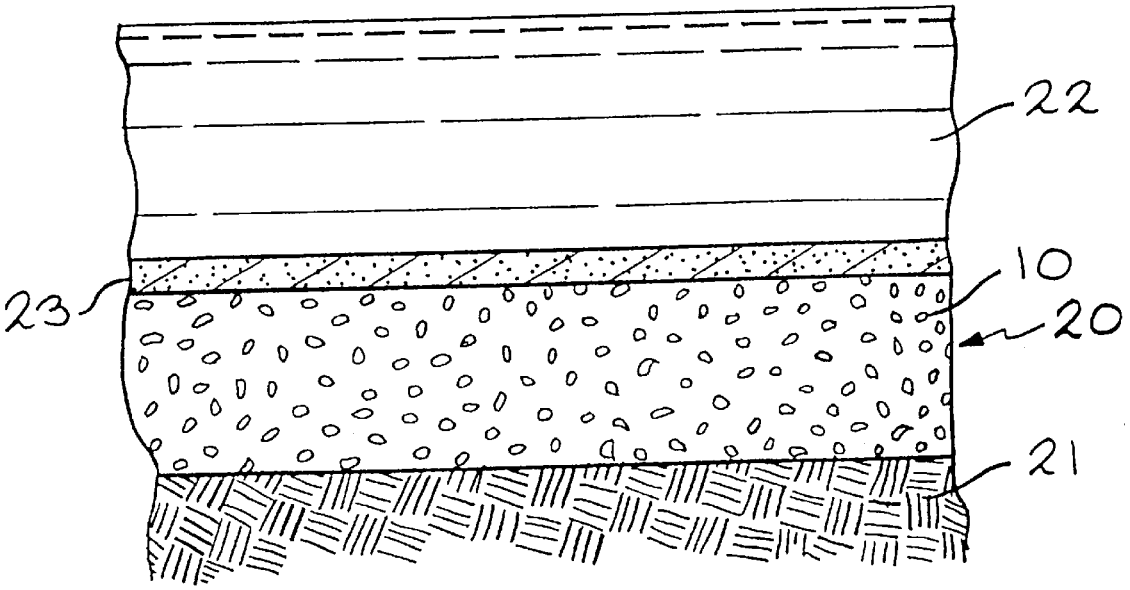
FIG. 2 is a sectional view of the barrier layer formed by a plurality of the composite particles.

An underwater barrier layer 20 formed from the composite particles 10 of this invention is illustrated in FIG. 2. The underwater barrier layer covers a layer of contaminated sediments 21 which lies beneath a body of water 22. To form this barrier layer, a plurality of the composite particles are deposited on top of the contaminated sediments. If the contaminated sediments are underwater at the time of the deposition, the composite particles may be dropped directly into the water. The composite particles will sink, settling on top of the contaminated sediments. Since the composite particles are relatively hard and impact resistant, they may be dropped into the water from the air, such as from a helicopter drop bucket. The composite particles may also be pumped out over the contaminated sediments using a conventional pump. They may also be deposited onto the contaminated sediments using a slinger from a barge or from the shore of a small creek or river. Alternatively, if the climate permits, the composite particles may be deposited when the water above the contaminated sediments is frozen. The composite particles may then be effectively deposited by means of a truck, road grader, low ground pressure bulldozer, or other suitable means. When the ice melts, the composite particles will sink to the bottom, settling on top of the contaminated sediments.

Once the composite particles are submerged, the sealant layer about each of the composite particles begins to absorb the water and to swell. A continuous layer of the sealant layer is thus formed, with the cores dispersed randomly throughout. It is believed that the cores aid in keeping the barrier layer intact on top of the contaminated sediments.

A sufficient number of the composite particles are deposited over the area to form a physical barrier layer of a thickness sufficient to prevent the migration of the contaminated sediments into the water. Generally, a barrier layer of a thickness of between about 4 to 8 cm is adequate to prevent the migration of contaminated sediments therethrough, as well as to prevent the animals and other organisms using that body of water from coming into contact with the sediments. Where a bird aversion agent has been added to the composite particles, it will be dispersed throughout the barrier layer, further discouraging foraging waterfowl from coming into contact with the contaminated sediments beneath the barrier layer.

If desired, additional particulate material such as fibers may also be mixed with the composite particles prior to their deposition on the contaminated sediments. Examples of such materials include recycled plastic, corn cobs, sawdust, recycled paper, carbon fibers and glass fibers. These additional materials help to bind the product together and in some cases may provide an enhanced medium for seed germination and plant growth within the barrier layer.

If a clay mineral is used in the selant layer 12, a cover layer 23 is preferably provided over the barrier layer 20 to minimize the dissipation of the clay mineral into the water 22, thereby effectively increasing the useful life of the barrier layer. Such a cover layer may be formed of a layer of aggregate, such as rocks, gravel or sand, which could also promote the stability of vegetation once established.

The following examples describe testing conducted to characterize the properties of the composite particles and demonstrate their superior properties:

EXAMPLE 1

The purpose of the first testing was to explore the relationships of size, composition, and density of a batch of the composite particles. This information is useful for predicting the settling behavior of the particles, and for optimizing the manufacturing and application process to achieve (or avoid) a particular settling behavior. In this testing, the composite particles were formed of a gravel core, a bentonite sealant layer and a cellulosic polymer binder for the bentonite.

Of particular importance are the settling velocity of the particles and their tendency to segregate during settling (Example 2), the tendency of the particles to disperse bottom sediments upon landing (Example 3), and the proportion of bentonite that they deliver to form the hydraulic barrier on the underwater surface of the water.

To evaluate size distribution, a representative sample of dry composite particles was split by quartering, passed through a series of sieves, and the size fraction retained on each sieve was weighed. The test was performed in general conformance with ASTM D 421, while taking care to minimize disturbance to the bentonite shells (sealant layer).

To evaluate the proportion of bentonite, the bentonite shells were removed from each size fraction.

Lastly, to determine the size distribution of the gravel, the gravel nuclei were washed, passed through the same sieve series, and each size fraction was weighed.

The following table summarizes the size distribution of the sample of dry composite particles, and the proportion of bentonite for each size fraction:

Sieve Analysis—Dry Composite Particles

| Sieve Size | % Weight Retained | % Weight Bentonite |
|---|---|---|
| ¾ inch | 25.0 | 44.8 |
| ⅜ inch | 65.4 | 52.1 |
| #4 | 9.0 | 67.4 |
| #10 | 0.4 | 69.8 |
| Pan | 0.2 | 100.0 |
| Total | 100.0 | 53.0 |

As the bentonite shells were removed from the gravel nuclei, it was observed that small particles generally have a thicker bentonite shell than large particles. The following table corroborates this observation, showing a substantially different size distribution of the washed gravel nuclei than that of the dry composite particles:

Sieve Analysis—Washed Gravel Nuclei

| Sieve Size | % Weight Retained |
|---|---|
| ¾ inch | 5.1 |
| ⅜ inch | 75.4 |
| #4 | 16.4 |
| #10 | 3.1 |
| Pan | 0.0 |
| Total | 100.0 |

It was concluded that small particles carry a higher proportion of bentonite than large particles. This is a characteristic of the manufacturing process. Small particles have a thicker bentonite shell than large particles. This is also a characteristic of the manufacturing process. Small particles also are less dense than large particles. This is because small particles carry a higher proportion of bentonite, and the bentonite shell is generally less dense than the gravel nucleus.

EXAMPLE 2

For any project, the composite particles encompass a range of particle sizes, each with a characteristic composition and density. Example 1 shows an example of this.

The settling velocity of any single composite particle in water depends on the size, density, and shape of the particle, and on the density and viscosity of the water as well. In general, though, the settling velocity of a large particle is higher than that of a small particle of the same density and shape. This is primarily because of geometry: a large particle has a lower surface-area-to-mass ratio than a small particle of the same density and shape. In addition to this, large composite particles are generally denser than small particles (Example 1).

The purpose of this testing is to explore the relationship between particle size and settling velocity of one batch of composite particles. This information is useful for predicting the tendency of the particles to segregate during settling, and their tendency to disperse bottom sediments upon landing (Example 3).

Ten representative particles were selected from each size fraction of a sample of dry composite particles. Each particle was then dropped through a 31-inch vertical column of water, timing the fall with a stop watch.

The following table summarizes average settling velocity by particle size, taken over ten trials for each size. The settling velocities were averaged for each size to eliminate differences due to the varied shapes of the particles. This table shows that large particles settle faster than small particles:

Avg. Settling Velocity v. Particle Size

| Sieve Size | Avg. Settling Velocity (ft./sec.) |
|---|---|
| ¾ inch | 1.94 |
| ⅜ inch | 1.55 |
| #4 | 1.03 |
| #10 | 0.72 |

These results show a direct relationship between particle size and settling velocity. However, they probably do not represent actual velocities that occur in the field. This testing did not consider interaction of the different particle sizes and upward convection currents as they fall through a column of water. Also, the timing of the fall included the initial acceleration of the particle to its terminal velocity.

It was concluded that small particles settle slower than large particles. This is because small particles have a greater surface-area-to-mass ratio than large particles. Also, smaller particles are less dense than large particles. Differences in settling velocity will cause segregation of the particles by size as they settle through a column of water. Particles with a "narrow" size distribution will have less tendency to segregate during settling than particles with a "wide" size distribution. Preferably, the narrow size distribution is such that at least about 50% (by weight) of the particles have a particle size within the range from about 50% of the median particle size to about 200% of the median particle size. More preferably, at least about 60% of the particles are within this narrow size range. Reducing the settling distance will also reduce the tendency of the particles to segregate during settling.

EXAMPLE 3

It is desirable to minimize the displacement and dispersion of bottom sediments potentially associated with application of the composite particles. This will avoid spreading contamination in the sediments, if any, and will reduce negative impacts to aquatic life. The purpose of this testing is to evaluate the tendency of one batch of composite particles to disperse sediments under simulated, worst-case bottom conditions.

Worst-case bottom conditions were simulated by mixing silty clay soil into an 8-inch diameter by 24-inch high column of water. The silt and clay particles were then allowed to naturally settle to the bottom of the water column. This column was left undisturbed for approximately 30 days to allow the sediments to naturally consolidate.

A sufficiently large, representative sample of composite particles was then dropped into the column, to cover the bottom sediments with a 3-inch thick layer. Following this application, the water was siphoned off from the column and passed through a 45-micron filter to capture the dispersed sediments. These dispersed sediments were then dried and weighed, and the penetration of the composite particles into the remaining bottom sediments was measured.

It was found that the composite particles displaced and dispersed approximately 72 grams of silty clay bottom sediments into the surrounding water. The composite particles penetrated approximately 1.5 inches into the bottom sediments. The silty clay bottom sediments were soft and offered little support to the composite particles. It is expected that for more coarse, competent bottoms, such as a silty sand, that the composite particles would penetrate less, and would disperse less bottom sediments.

It was concluded that the application of composite particles onto fine-grained, soft bottom sediments tends to displace and disperse these sediments into the surrounding water, as will any such disturbance to these worst-case bottom sediments. More competent, coarse-grained bottom sediments are less prone to dispersion. Small composite particles have lower settling velocities (Example 3) and have less tendency to disperse bottom sediments. Preferably, at least about 60% (by weight) of the composite particles have a particle size less than ¾ inch, and more preferably at least about 70%. Reducing the settling distance may reduce settling velocities and the tendency to disperse bottom sediments. This may be achieved by carefully applying the composite particles from a pipe outlet close to the bottom.

EXAMPLE 4

The composite particles were developed to deliver dry bentonite underwater where they hydrate to form a submerged hydraulic barrier. Low hydraulic conductivity of the hydrated particles is therefore very important. The purpose of this testing is to evaluate the hydraulic conductivity of one batch of composite particles.

A representative sample of composite particles was prepared for testing in a thin-walled permeameter in general conformance to ASTM D 5084. After placing the sample in the permeameter, the composite particles were thoroughly saturated with de-aired water under pressure to assure that they were completely saturated prior to the test. This process took approximately two weeks, until the sample stopped taking in water from both ends.

After complete saturation, this hydraulic conductivity test was run under a constant hydraulic gradient of 28 cm/cm for a period of 80 days. It was observed that the hydrated sample of composite particles exhibited a hydraulic conductivity coefficient of $5.93\times10^{-9}$ cm/sec.

Note, however, that this test measures only advective-dispersive, or "mechanical" type flow. Some contaminants can migrate through a clay-based hydraulic barrier by diffusive or "chemical" transfer, at a rate faster than by advective-dispersive flow.

It was concluded that hydrated composite particles are highly impervious to advective-dispersive flow, even under a relatively large hydraulic gradient. The hydraulic conductivity of the hydrated composite particles is on the order that one would expect for hydrated bentonite. The presence of gravel in the composite particles does not appear to adversely affect the hydraulic conductivity of the hydrated bentonite.

EXAMPLE 5

The purpose of this test was to evaluate the resistance of a barrier layer of the composite particles to erosion caused by water flowing over the barrier.

To simulate erosive conditions in the laboratory, an acrylic sluice box was constructed, approximately 24-in. long, 6-in. wide, and 12-in. high. Partitions were set in both ends of the sluice to control up-stream and down-stream water levels, thereby providing for steady-state flow.

2–3 inches of pea gravel were placed in the bottom of the sluice between the partitions, to allow the sample of composite particles to hydrate from the bottom as well as from the top. Then 2 inches of dry particles were placed over the pea gravel, and this layer was covered with water. The composite particles were allowed to saturate under these conditions for 24 hours.

A constant flow of water was then introduced over the particles, at a rate of 5.5 gpm. The depth of flow was measured at twenty points along the sluice, finding an average flow depth of 0.74 ft. Using this data, an average flow velocity of 0.40 ft./sec. was calculated.

During this test, the hydrated composite particles were visually observed for evidence of erosion. On day two of the test some erosion was noticed, evidenced by the slight appearance of gravel nuclei on the surface. The most notable erosion occurred where the water was cascading over the upstream partition.

These conditions remained constant until day eleven, with no noticeable increase in erosion. Pump failure interrupted this test on day eleven. However, this incident added a new dimension to the test: the sample was allowed to dry over the next seventeen days, forming desiccation cracks prior to restarting the flow.

Again, over the first two days of this second run, some erosion appeared on the upstream portion of the sample. Thereafter, no additional erosion appeared through day fifty-four of the second run, when we terminated the test. The desiccation cracks appeared to completely heal by day four of the second run.

It was concluded that after slight initial erosion, the mass of composite particles stabilized with no further erosion for the duration of the test. Desiccation cracks in the mass of composite particles can heal under flowing conditions.

EXAMPLE 6

The purpose of this testing was to evaluate the effects of freezing and thawing of hydrated samples of the composite particles.

Five samples of composite particles were prepared in four-inch square clear plastic containers. These containers were selected to allow observation of freeze-thaw effects, and to minimize confining pressure on the samples.

500 ml. of tap water was added to each container, and then a 2-inch thick layer of dry composite particles was added.

Then, the particles were allowed to hydrate, periodically adding water to achieve complete saturation. The volume of each sample approximately doubled, with a total water volume in the range of 1,100 to 1,200 ml. each.

Each sample was then subjected to five freeze-thaw cycles, recording the condition of the samples after each cycle. In general, each freezing event produced discrete, open fractures which contained free water that probably migrated from water on top of the sample. Some of these fractures completely penetrated any of the samples. The position and orientation of these fractures was noted by tracing them with a marker on the clear plastic containers. All fractures appeared to completely heal upon thawing of the samples.

Subsequent freezing produced new fractures of different position and orientation. Again, these fractures completely healed upon thawing of the samples. No fractures persisted from one cycle to the next.

It was concluded that freezing of hydrated composite particles produces discrete, open fractures. The fractures heal, and the mass of hydrated composite particles returns to its original homogeneous state upon thawing.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A flowable material to isolate or treat a surface comprising a plurality of manufactured composite particles, wherein each composite particle comprises:

a core, and a sealant layer at least partially encapsulating the core, the sealant layer comprising a hydratable sealant material that is capable of absorbing water and swelling, the core being relatively dense compared to the sealant layer, and the composite particle having a specific gravity greater than one, wherein the sealant layer when hydrated absorbs water and swells to form a barrier layer containing a continuous layer of the sealant material, the barrier layer having a low water permeability effective to prevent leakage of water and contaminants.

2. A flowable material as defined in claim 1 wherein the barrier layer has a permeability of less than $1\times10_{-7}$ cm/sec. under a minimum hydraulic gradient of 1 cm/cm and wherein the sealant material is selected from the group consisting of clay minerals, pozzolanic materials, and mixtures thereof.

3. A flowable material as defined in claim 1 which comprises a barrier layer on a land surface.

4. A flowable material as defined in claim 3 wherein the materials comprising the composite particles are relatively uniformly distributed in the barrier layer.

5. A flowable material as defined in claim 3 wherein the barrier layer provides a barrier to birds and rodents.

6. A flowable material as underwater claim 1 which comprises an underwater barrier layer.

7. A flowable material as defined in claim 1 wherein the sealant layer comprises a material selected from the group consisting of clay minerals, pozzolanic materials, activated carbon, and mixtures thereof.

8. A flowable material as defined in claim 1 wherein the sealant layer comprises a dry clay mineral.

9. A flowable material as defined in claim 1 wherein the sealant layer comprises an organically modified clay mineral.

10. A flowable material as defined in claim 1 wherein the sealant layer comprises activated carbon.

11. A flowable material as defined in claim 1 wherein the composite particles are manufactured by compressing the sealant layer against the core.

12. A flowable material as defined in claim 1 wherein each composite particle additionally comprises a binder.

13. A flowable material as defined in claim 12 wherein the binder is water.

14. A flowable material as defined in claim 12 wherein the binder is selected from the group consisting of polymeric materials, glues, lignites, starch grafted polyacrylates, soybean oil lecithins, and mixtures thereof.

15. A flowable material as defined in claim 1 wherein the composite particles are manufactured by coating the core with water and then applying the sealant layer around the coated core.

16. A flowable material as defined in claim 1 wherein each composite particle additionally comprises a material to improve the surrounding environment.

17. A flowable material as defined in claim 16 wherein the material to improve the environment is selected from the group consisting of bacteria, enzymes, fungi, algae, neutralizing agents, remedial chemicals, activated carbon, seeds, fertilizer, and mixtures thereof.

18. A flowable material as defined in claim 16 wherein the composite particle contains fertilizer and a microorganism selected from bacteria, algae and fungi.

19. A flowable material as defined in claim 1 wherein the composite particles have a median particle size, and at least about 50% to the particles have a particle size within the range from about 50% of the median particle size to about 200% of the median particle size.

20. A flowable material as defined in claim 1 wherein at least about 60% of the composite particles have a particle size less than ¾ inch.

21. A flowable material as defined in claim 1 wherein the composite particles are substantially resistant to erosion by water flow at an average velocity of 0.40 feet per second.

22. A flowable material as defined in claim 1 wherein the composite particles are substantially resistant to freeze-thaw effects such that the composite particles return to a homogeneous state upon thawing.

23. A flowable material to isolate or treat a surface comprising a plurality of manufactured composite particles, wherein each composite particle comprises:

a degradable core, and a sealant layer at least partially encapsulating the core, the sealant layer comprising a hydratable sealant material that is capable of absorbing water and swelling, the core being relatively dense compared to the sealant layer, and the composite particle having a specific gravity greater than one, wherein the sealant layer when hydrated absorbs water and swells to form a barrier layer containing a continuous layer of the sealant material, the barrier layer having a low water permeability effective to prevent leakage of water and contaminants.

24. A flowable material as defined in claim 23, wherein the degradable core is formed of a material selected from the group consisting of sand, small stones, rubber tire chips, sugar-based materials, pelletized paper, pelletized slow-hydrating clay mineral, high-density fertilizer, and mixtures thereof.

25. A flowable material to isolate or treat a surface comprising a plurality of manufactured composite particles, wherein each composite particle comprises:

a core, and a sealant layer at least partially encapsulating the core, the sealant layer comprising a pozzolanic material that is capable of absorbing water and swelling, the core being relatively dense compared to the sealant layer, and the composite particle having a specific gravity greater than one, wherein the sealant layer when hydrated absorbs water and swells to form a barrier layer containing a continuous layer of the pozzolanic material, the barrier layer having a low water permeability effective to prevent leakage of water and contaminants.

26. A flowable material as defined in claim 25 wherein the pozzolanic material is selected from the group consisting of gypsum, gypsum fines, portland cement, cement kiln dust, lime dust, stone dust, fly ash, plaster of Paris, and mixtures thereof.

* * * * *